United States Patent [19]

Lintonbon et al.

[11] 4,270,884

[45] Jun. 2, 1981

[54] WASTE GAS RECOVERY SYSTEM

[75] Inventors: Robert F. Lintonbon, Weybridge; David Shore, Maidenhead, both of England

[73] Assignee: Ferakarn Limited, London, England

[21] Appl. No.: 92,029

[22] Filed: Nov. 7, 1979

[30] Foreign Application Priority Data

Nov. 10, 1978 [GB] United Kingdom ..... 43961/78

[51] Int. Cl.[3] ..... F04B 49/00

[52] U.S. Cl. ..... 417/15; 417/26; 417/53; 417/292; 417/295; 417/438

[58] Field of Search ..... 55/20, 21, 23, 84, 467; 417/15, 26, 28, 32, 53, 4, 292, 295, 438; 62/93; 60/600-603, 39.53, 728; 123/25; 415/116, 117, 175, 176

[56] References Cited

U.S. PATENT DOCUMENTS

| | | | |
|---|---|---|---|
| 1,346,898 | 7/1920 | Kingsbury | 417/36 X |
| 2,042,991 | 6/1936 | Harris | 417/438 X |
| 2,645,409 | 7/1953 | Lawler | 60/600 X |
| 2,876,865 | 3/1959 | Cobb | 55/23 X |
| 3,091,097 | 5/1963 | Friant | 62/93 X |
| 3,180,266 | 4/1965 | Smith | 417/292 X |
| 3,785,749 | 1/1974 | Perry et al. | 417/28 X |
| 3,799,702 | 3/1974 | Weishaar | 417/38 |
| 3,957,395 | 5/1976 | Ensign | 417/28 X |

FOREIGN PATENT DOCUMENTS

| | | | |
|---|---|---|---|
| 846907 | 9/1939 | France | 417/438 |
| 1506024 | 4/1978 | United Kingdom . | |

OTHER PUBLICATIONS

"Flare Gas Recovery System Saves Fuel," Processing Magazine, by Lintonbon, Feb. 1978.

*Primary Examiner*—Carlton R. Croyle
*Assistant Examiner*—Edward Look
*Attorney, Agent, or Firm*—James H. Grover

[57] ABSTRACT

A waste gas recovery system employs a compressor which takes in raw waste gas from an inlet knock-out drum and passes compressed gas through a heat exchanger to an outlet knock-out drum. The temperature at the outlet of the compressor is sensed by a device which operates valves to inject liquid coolant into the compressor inlet and to re-circulate gas back from the outlet of the outlet knock-out drum to inhibit an excessive temperature rise. A pressure-sensing device senses the pressure of the gas passing into the compressor and controls both the speed of the compressor and an adjustable throttle valve to regulate the gas flow. The throttle valve is closed automatically should there be a fall in the pressure of the gas at the inlet below a safe level. In this event, further pressure-sensing devices act additionally to close the recirculating gas valve and a further valve in the main inlet flow path to reliably isolate the compressor.

19 Claims, 1 Drawing Figure

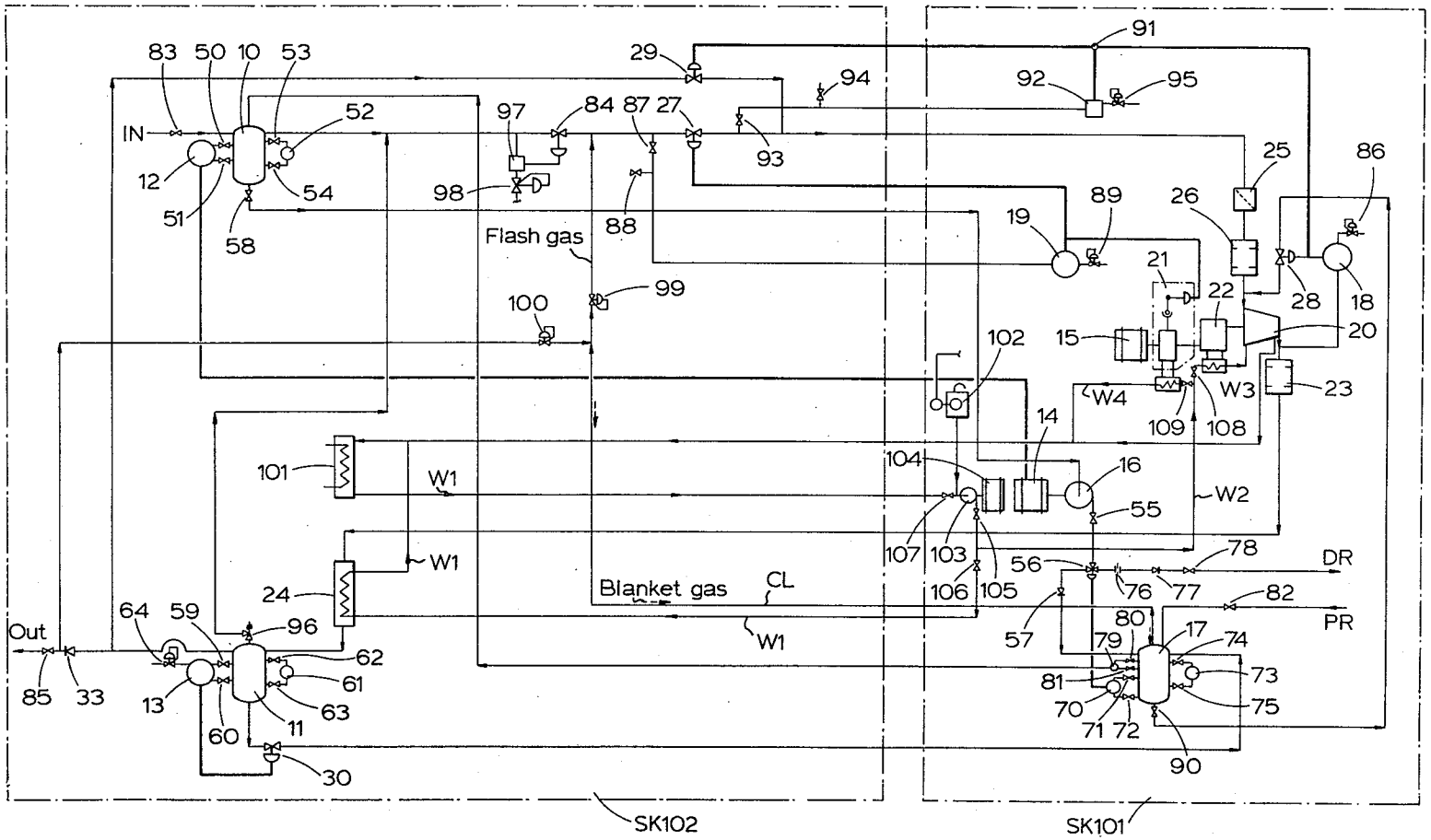
SK101
SK102
DR
PR
W1
W2
W3
W4
CL
Blanket gas
Flash gas
IN
Out

WASTE GAS RECOVERY SYSTEM

BACKGROUND TO THE INVENTION

The present invention relates in general to waste gas recovery systems.

It is well known to burn off or discharge waste gas arising in process plants used in the oil and chemical industries. Normally, the waste gas is passed to a flare which is elevated and is burnt off at the top of the flare. Nowadays, there is a tendency to utilize recovery systems which process waste gas for utilization as a fuel. The recovery system would supplement the normal flare system so that the latter would still operate in abnormal emergency conditions where there is a need to dispose of a large quantity of waste gas. A recovery system is described in the U.S. patent application of R. Lintonbon and D. Shore, Ser. No. 949,091 filed Oct. 6, 1978 which employs control means to ensure that the recovery system is able to cope with expected variations in pressure and flow rates of the gas.

A general object of the present invention is to provide an improved form of recovery system. More particularly, an object of this invention is to provide a recovery system which will ensure that the waste gas recovery is achieved in a safe, reliable manner without adversely affecting the normal flare system so that on no account could air be drawn into the flare system, thereby creating a dangerous situation.

SUMMARY OF THE INVENTION

As is known, the present invention relates to a waste gas recovery system which employs a compressor which takes in the raw waste gas and passes the compressed gas to an output and, preferably, through a cooler to the output. In accordance with this invention as set forth hereinafter, parameters are sensed in the system and control functions are initiated to protect the compressor to ensure that the compressor is not starved of gas and does not operate under adverse conditions, leading to excessive temperatures and also to ensure the compressor is isolated from the inlet, and hence from the flare system, should the gas pressure drop below a safe level.

In one aspect, the invention provides a method of controlling the operation of a waste gas recovery system which employs a compressor taking in raw waste gas from a main inlet and passing compressed waste gas to a main outlet; said method comprising sensing the temperature of the gas at the outlet of the compressor, operating control means in accordance with the sensed temperature to act on the gas fed into the compressor to reduce the temperature in the event of a sensed temperature rise, sensing the pressure of the gas fed to the compressor with a plurality of individual pressure-sensing means, utilizing one of said pressure-sensing means to control the drive speed of the compressor and to adjust an adjustable throttle valve to regulate the gas flow and utilizing the collective pressure-sensing means to operate shut-off means to isolate the compressor from the inlet means in the event of a sensed pressure falling below a minimum safety threshold level.

The temperature control can serve to cool and stabilize the outlet gas while the pressure control serves to regulate the gas flow supply to the compressor. Preferably, the operation of the shut-off means is accompanied by halting of the compressor in the event of pressure failure or drop and this can be accomplished by a known vacuum switch as part of the compressor controls.

A waste gas recovery system made in accordance with the invention may comprise a main inlet for receiving raw waste gas for processing, a compressor connected to the main inlet to receive and compress the waste gas, a main outlet for discharging the compressed waste gas, means for sensing the temperature of the gas at the outlet of the compressor, temperature control means responsive to the temperature sensing means and operable on the gas fed to the compressor to reduce the temperature of the gas at the outlet of the compressor in the event of a sensed temperature rise, a plurality of pressure-sensing means for individually sensing the pressure of the gas being fed to the compressor, means for driving the compressor at a selectively-variable speed under control of a first of said pressure-sensing means, an adjustable throttle valve for further regulating the flow of gas to the compressor under control of said first pressure sensing means and shut-off means for isolating the compressor from the main inlet when the pressure sensed by the collective pressure-sensing means falls below a minimum safety threshold.

The temperature control means may constitute a control valve or valve means operable to inject liquid acting as a coolant into the waste gas entering the inlet of the compressor, and/or a control valve or valve means operable to recycle gas from the outlet of the overall system back to the inlet of the compressor, in the event that the temperature should rise beyond a predetermined value.

The first pressure-sensing means which controls the compressor drive and the adjustable throttle valve closes the latter in the event that the pressure falls below the safety level. Hence, the throttle valve constitutes part of the shut-off means. Another pressure-sensing means may act to shut-off the control valve or valve means which allows re-circulation gas to pass to the compressor inlet so that this valve or valve means also constitutes part of the shut-off means. This other or second pressure-sensing means may act to disable or interrupt the control signal path between the temperature sensing-means and the associated valve or valve means allowing gas re-circulation to effect the closure of this valve or valve means. A further pressure-sensing means may also act to shut off a further valve constituting part of the shut-off means. This further valve may be between the main inlet and the compressor inlet and, more preferably, between the main inlet and the throttle valve.

It is preferable, also, to utilize one or more knock-out drums to remove liquid as condensate from the waste gas being processed. This liquid can be collected and used as the coolant injected into the inlet gas of the compressor. Thus, the main inlet can be connected to an inlet knock-out drum for removing liquid as condensate from the raw waste gas and the main outlet can be connected to an outlet knock-out drum for removing liquid as condensate from the compressed waste gas for discharge. Preferably, the liquid condensate is stored in a header tank maintained under a substantially constant pressure head. The header tank is preferably subjected to internal gas pressure and control means or pressure regulators can be used to take off excess gas from the header tank or to feed supplementary gas from part of the system, conveniently, at the outlet thereof, back to the header tank to maintain this internal gas pressure within a predetermined range.

Preferably, a control valve serves to prevent excessive gas pressure from building up in the outlet knock-out drum. This valve may open at a certain pressure to permit gas to be fed from the outlet knock-out drum back to the compressor inlet.

Instead of using condensate as the coolant, it is possible for a separate coolant to be supplied to the compressor inlet in case of need.

It is desirable to cool the compressed waste gas. A heat exchanger can be provided for this purpose. Coolant can be circulated through the heat exchanger and the compressor and preferably this coolant can be itself cooled by passage through another heat exchanger.

The invention may be understood more readily, and various other preferred features of the invention may become apparent, from consideration of the following description.

BRIEF DESCRIPTION OF DRAWING

An embodiment of the invention will now be described, by way of example only, with reference to the accompanying drawing, which is a block schematic representation of a waste gas processing and recovery system made in accordance with the invention.

DESCRIPTION OF PREFERRED EMBODIMENT

As shown in the accompanying drawing, the system consists of a number of component units and devices variously interconnected by pipes or conduits defining liquid and gaseous flow paths. The system employs two knock-out drums; namely, an inlet knock-out drum 10 and an outlet knock-out drum 11. The drums 10,11 are respectively associated with liquid-level sensing and control devices 12,13. The device 12 is connected via isolating valves 50,51 to the interior of the drum 10 to sense the level of condensate liquid therein and to provide a control signal dependent on the sensed level. A visual indication of the condensate liquid level in the drum 10 is provided by a level gauge 52 connected to the interior of the drum 10, via isolating valves 53,54. The level signal provided by the device 12 controls an electric motor 14, which drives a pump 16, which draws liquid condensate from the drum 10 from time to time via an isolating valve 58. The pump 16 feeds the liquid to a header tank 17 via an isolating valve 55, a three-way control valve 56 and a non-return valve 57.

The device 13 is similarly connected to the interior of the drum 11 via isolating valves 59,60 to sense the level of condensate liquid therein and provides a control signal dependent on the sensed level. A pressure regulator 64 is also connected to the device 13. A visual indication of the condensate liquid level in the drum 11 is provided by a level gauge 61 connected to the interior of the drum 11 via isolating valves 62,63. The level signal provided by the device 13 operates a control valve 30, which permits or inhibits the flow of liquid condensate from the drum 11 to the header tank 17.

A liquid level sensing and control device 70 is connected to the interior of the tank 17 via isolating valves 71,72 to sense the level of condensate liquid therein and provides a control signal dependent on the sensed level. A visual indication of the condensate liquid level in the tank 17 is provided by a level gauge 73 connected to the interior of the tank 17 via isolating valves 74,75. The level signal provided by the device 70 controls the control valve 56. In the event of liquid build-up in the tank 17 beyond a certain level, the valve 56 is operated by the signal from the device 70 to divert the liquid from the pump 16 to a drain DR via a restriction orifice 76, a non-return valve 77 and an isolating valve 78. The tank 17 is also provided with an overflow system which is effective in the event of further excessive liquid build up after the valve 56 has diverted the liquid from the pump 16. This overflow system comprises a liquid control device 79 connected to the interior of the tank 17 via isolating valves 80,81 serving to feed liquid back to the top of the drum 10, as shown.

When the system initially commences operation, or after shut down, it may be necessary to supply priming liquid to the tank 17. For this purpose, a priming line PR leads to the tank 17 via an isolating valve 82.

It is desirable to provide a certain reasonably constant gas head pressure in the tank 17 and in the system, as illustrated, flash gas is taken off from the tank 17 or blanket gas fed to the tank 17 to maintain the desired pressure via a common gas line CL and control means described hereinafter.

Waste gas is fed into the drum 10 via a main gas inlet IN and an isolating valve 83. The gas outlet from the drum 10 is fed via an isolating control valve 84 to an adjustable-throttle pressure control valve 27 and thence via a strainer unit 25 and a silencer 26 to the inlet of a compressor 20. The outlet from the compressor 20 is fed through a silencer 23 and a heat exchanger 24 to the knock-out drum 11. The outlet from the drum 11 is fed via a non-return valve 33 and an isolating valve 85 to a main gas outlet OUT. The compressor 20 is driven by an electric motor 15, a speed control arrangement 21 and gearing in a gear box 22. The arrangement 21 may operate to effect electrical or mechanical speed control of the compressor drive.

A pressure sensing and control device 19 senses the pressure prevailing at the outlet of the drum 10 and provides a corresponding control signal. More particularly, the device 19 is connected through an isolating valve 87 to the junction between the valves 84 and 27 and to a one-way vent 88. A pressure regulator 89 is also connected to the device 19. The signal produced by the device 19 serves to control the speed control arrangement 21 and the valve 27. Thus, according to the pressure sensed by the device 19, the drive speed of the compressor 20 is varied and the valve 27 is adjusted progressively to vary its throttle opening.

A temperature sensing and control device 18 senses the temperature prevailing at the outlet of the compressor 20 and provides a corresponding control signal. A pressure regulator 86 is connected to the device 18. A control valve 28 is connected via an isolating valve 90 to the tank 17 and to the compressor inlet. The signal provided by the device 18 controls the valve 28 which opens to draw off liquid from the tank 17 for injection into the compressor inlet when the device 18 detects a temperature level in excess of a predetermined value.

A re-circulatory gas path is established between the outlet of the drum 11 and the inlet of the strainer unit 25 via a control valve 29. The signal produced by the device 18 also controls the valve 29 so that a certain proportion of the outlet gas can be fed back from the drum 11 to the compressor 20, when the valve 29 is opened. The valve 29 would normally be set to actuate at a higher temperature than the valve 28. The signal path from the device 18 to the valve 29 can be interrupted by a switching device 91 which may be a pneumatic relay. The switching state of the device 91 is controlled by means of a pressure sensing device 92. This device 92 is connected via an isolating valve 93 to sense the pressure at the inlet of the strainer unit 25. The device 92 is also connected to a one-way vent 94 and to a pressure regulator 95.

The gas head in the drum 11 is connected via a regulating device 96 to the outlet from the drum 10 so excessive pressure build up in the drum 11 can be precluded.

The valve 84 is connected to a further pressure sensing device 97 which, in turn, senses the pressure at the input to the valve 84. The device 97 is connected to a pressure regulator 98. The compressor 20 would be additionally protected with the aid of a vacuum switch as known per se.

The gas line CL to the tank 17 is connected via a pressure regulating device 99 to the junction between the valves 84,27 and via a pressure regulating device 100 to the junction between the valve 33,85. Excess pressure, as caused by flash gas in the tank 17, will cause the device 99 to open to relieve the pressure in the line CL. Conversely, a fall in the head pressure in the tank 17 will cause the device 100 to open to draw in blanket gas from the outlet of the drum 11. The devices 99,100 which are, of course, set to actuate at different pressures thus supply and draw off gas from the tank 17 to maintain the liquid therein under a reasonably constant pressure.

The system employs circulating coolant to cool the compressor 20, the gear box 22, the speed changing arrangement 21 (where this is a mechanical arrangement) and the heat exchanger 24. This main circulating coolant is itself cooled separately by a further heat exchanger 101. In this embodiment, the main circulating coolant is fresh water while the coolant for the heat exchanger 101 can be brackish water unsuitable to pass through the system. The main coolant water is supplied to a header tank 102 employing a ball valve or the like to maintain a constant level of water in the tank 102. The tank 102 would normally employ an overflow pipe. The tank 102 feeds the coolant water to the inlet of a pump 103 drive by a motor 104. In the event of a failure in the supply of water to the tank 102, the motor 104 and the pump 103 are designed to shut down. This can be achieved by using a water level sensing device (not shown) which interrupts the power supply to the motor 104 should the water level drop to a minimum value. The pump 103 feeds the coolant water through an isolating valve 105 from whence the water splits into two paths, W1,W2. One path, W1, passes through an isolating valve 106 through the heat exchangers 23,101, as shown, and back to the pump inlet via an isolating valve 107. The other path W2, is in turn sub-divided into two paths, W3,W4. One path, W3, passes through an isolating valve 108, and through cooling jackets of the gear box 22 and the compressor 20 to join the path W1 entering the heat exchanger 101. The other path, W4, passes through an isolating valve 109 and through the cooling jacket of the speed-changer arrangement 21 and joins the paths W1,W3 entering the heat exchanger 101.

The operation of the system is as follows:

The waste gas to be processed and arising in a plant enters the drum 10 at "IN" and a proportion of liquid entrained in the gas condenses in the drum 10. The gas then passes through the normally-open valves 84,27 through the strainer unit 25 and the silencer 26 into the inlet of the compressor 20. The gas is thence compressed and passes through the silencer 23 and through the heat exchanger 24, which cools the gas, to the drum 11. Liquid entrained in the gas again condenses in the drum 11 and the gas taken from the outlet of the drum 11 to the outlet "OUT" is suitable to be conveyed into a fuel gas main of the plant.

Variation in the pressure of the incoming gas fed to the compressor 20 is detected by the device 19 and variation in the temperature of the gas at the outlet of the compressor 20 is detected by the device 18. The device 19 directly controls the speed of the compressor drive and the speed of the compressor 20 is automatically varied to compensate for any change in the incoming gas pressure. In addition, the device 19 controls the throttle opening of the valve 27 in accordance with the sensed pressure. This pressure-sensitive control ensures that the compressor 20 operates within a certain speed range and maintains reasonably constant operating characteristics while the inlet gas to the compressor 20 is kept within a desired range of pressure variation. When the compressor 20 is operating at minimum speed, a further reduction in the pressure of the incoming gas would give rise to a temperature rise at the outlet from the compressor 20. At a certain temperature, the device 18 actuates the valve 28, which then injects liquid taken from the header tank 17 onto the gas passing into the compressor 20. The liquid tends to cool the gas and the device 18 may cause the valve 28 to cycle and switch on and off to restrict the temperature of the gas at the outlet of the compressor 20. In the event that the injection of fluid is not sufficiently effective to restrict the temperature rise, the valve 29, which is set to switch at a higher temperature than the valve 28, will be opened by the device 18. Gas is now re-circulated from the drum 11 back to the compressor 20 and this gas, which is cooled by the heat exchanger 24, will assist in reducing the temperature of the gas in the compressor 20. In this event, the compressor 20 operates with gas re-circulating between the outlet and inlet and this gas, which is cooled by the heat exchanger 24, and may be additionally cooled by liquid injection, ensures that the compressor 20 is protected.

Nevertheless, if the pressure of the waste gas drops still further to a minimal safety threshold value, or should fail entirely, it is imperative to isolate the compressor 20 from the inlet IN to avoid the creation of a suction at the inlet IN. If the pressure falls below the safety threshold, the switching device 91 will be actuated by the pressure sensing device 92 to interrupt the control path from the device 18 and this will cause the valve 29 to close. The valve 27 is also closed directly by the device 19 and the valve 84 would also be closed with the aid of the device 97. Thus, under such adverse or failure conditions, the valves 27,84,29 form a shut-off means to ensure the compressor 20 is isolated from the inlet IN. The compressor 20 may still have liquid injected at its inlet by the valve 28 but its vacuum switch would sense that no gas is being received and would normally shut down the compressor 20 entirely under these adverse conditions.

Although in the illustrated embodiment the compressor 20 is driven by an electric motor, it is possible to utilize a turbine as the drive means.

The units and devices of the system, as illustrated and described, can be conveniently mounted on one or more skid structures designated by chain-dotted lines SK101, SK102, which facilitates installation on site.

Certain of the units and devices would need to be adapted to the particular conditions and requirements prevailing. Nevertheless, in a typical system:

the compressor 20 can be an Aerzen type VRO 325L/125L;

the valves 28,29 can each be a Fisher type 657A or 657R;

the devices 18,19,92,97 can each be a Taylor Series 440;

the valve 27 can be a GEC Elliot type 7600;

the pumps 103,16 can be Ryax S1H1 type pumps;

the electric motors 104,15 can be made by Brooks and are compatible with the pumps 103,16;

the electric motor 15 can be made by Brush and is compatible with the compressor 20 and the drive arrangements 21,22.

the regulators 99,100 can be Fisher type 630;

the regulators 64,98,89,86,95 can be Fisher type 67FR;

the non-return valves 33,77,57 can be Hattersley-Newman Hender type 4936.

the devices 12,70 can be Mobrey type LS1Z/1;

the device 13 can be a Fisher type 249B-2500;

the vent valves 94,88 can be Hattersley-Newman Hender type 528;

the three-way valve 56 can be Fisher type 657-YY;

the control valves 84,30 can be Fisher type 657-AR;

the level gauges 52,61,73 can be Klinger type 21;

the isolating valves 50,51,53,54,55,58 62,63,71,72,74,75,80,81,105,83,85,90,107 can be Hattersley-Newman Hender type 7767;

the isolating valves 59,60,78,82,108,109, 106, can be Hattersley-Newman Hender type "V" reg;

the isolating valves 87,93 can be Hattersley-Newman Hender type 528;

the relief valve 96 can be Farris type 2600; and the relay 91 can be a Fisher type 2601A.

We claim:

1. A waste gas recovery system comprising a main inlet for receiving raw waste gas for processing, a compressor connected to the main inlet to receive and compress the waste gas, a main outlet for discharging the compressed waste gas, means for sensing the temperature of the gas at the outlet of the compressor, temperature control means responsive to the temperature sensing means and operable on the gas fed to the compressor to reduce the temperature of the gas at the outlet of the compressor in the event of a sensed temperature rise, a plurality of pressure-sensing means for individually sensing the pressure of the gas being fed to the compressor, means for driving the compressor at a selectively-variable speed under control of a first of said pressure-sensing means, an adjustable throttle valve for further regulating the flow of gas to the compressor under control of said first pressure-sensing means and shut-off means for isolating the compressor from the main inlet when the pressure sensed by the collective pressure-sensing means falls below minimum safety threshold level.

2. A system according to claim 1, wherein the temperature control means comprises a control valve operable to inject liquid as coolant into the inlet of the compressor.

3. A system according to claim 1, wherein the temperature control means comprises a control valve operable to allow gas to be re-circulated from the main outlet to the inlet of the compressor.

4. A system according to claim 1, wherein the temperature control means comprises a control valve operable to inject liquid as coolant into the inlet of the compressor and a further control valve operable to allow gas to be re-circulated from the main outlet to the inlet of the compressor.

5. A system according to claim 3, wherein the shut-off means comprises the throttle valve which is closed by the first pressure-sensing means, the control valve effective to re-circulate gas which is closed by a second pressure-sensing means and a further valve which is connected between the throttle valve and the main inlet and which is closed by a third pressure-sensing means.

6. A system according to claim 5, wherein the first pressure-sensing means senses the pressure between the control valve effective to re-circulate gas and the throttle valve, the second pressure-sensing means senses the pressure at the inlet of the compressor and the third pressure-sensing means senses the pressure at the inlet to the further valve.

7. A system according to claim 1, wherein the main inlet is connected to an inlet knock-out drum for removing liquid as condensate from the raw waste gas and the main outlet is connected to an outlet knock-out drum for removing liquid as condensate from the compressed waste gas for discharge.

8. A system according to claim 7, wherein excessive gas pressure is prevented from building up in the outlet knock-out drum by means of a control valve which opens at a predetermined pressure to permit gas to be fed from the outlet knock-out drum back to the compressor inlet.

9. A system according to claim 2, wherein the main inlet is connected to an inlet knock-out drum for removing liquid as condensate from the raw waste gas and the main outlet is connected to an outlet knock-out drum for removing liquid as condensate from the compressed waste gas for discharge and wherein the liquid coolant injected into the compressor inlet by the associated control valve is liquid condensate collected from the inlet and outlet knock-out drums.

10. A system according to claim 9, wherein the liquid condensate is stored in a header tank maintained under a substantially constant pressure head.

11. A system according to claim 10 and further comprising control means for maintaining the substantially constant pressure head in the header tank, said control means serving to draw off excess gas from the header tank and to feed said excess gas to the compressor inlet or to feed supplementary gas back from the main outlet back to the header tank.

12. A system according to claim 1, and further comprising a heat exchanger for cooling the compressed waste gas fed to the main outlet.

13. A system according to claim 12, wherein coolant liquid is circulated through the heat exchanger and the compressor.

14. A system according to claim 13, wherein the coolant is itself cooled by means of a further heat exchanger.

15. A method of controlling the operation of a waste gas recovery system which employs a compressor taking in raw waste gas from a main inlet and passing the compressed waste gas to a main outlet; said method comprising sensing the temperature of the gas at the outlet of the compressor, operating control means in accordance with the sensed temperature to act on the gas fed into the compressor to reduce the temperature in the event of a sensed temperature rise, sensing the pressure of the gas fed to the compressor with a plurality of individual pressure-sensing means, utilizing one of said pressure-sensing means to control the drive speed of the compressor and to adjust an adjustable throttle valve to regulate the gas flow and utilizing the collective pressure-sensing means to operate shut-off means to isolate the compressor from the inlet means in the event of a sensed pressure falling below a minimum safety threshold level.

16. A method according to claim 15, wherein the operation of the control means responsive to a sensed temperature rise involves opening a valve to inject liquid coolant into the inlet of the compressor.

17. A method according to claim 15, wherein the operation of the control means responsive to a sensed temperature rise involves opening a valve to allow gas to re-circulate from the main outlet back to the inlet of the compressor.

18. A method according to claim 15, wherein the operation of the control means responsive to a sensed temperature rise involves opening a valve to inject liquid coolant into the inlet of the compressor and opening a further valve to allow gas to re-circulate from the main outlet back to the inlet of the compressor.

19. A method according to claim 17, wherein the operation of the shut-off means involves closure of the throttle valve by said one pressure-sensing means, closure of the gas recirculating valve by a second pressure-sensing means and closure of a further valve connected between the throttle valve and the main inlet by a third pressure-sensing means.

* * * * *